US011673633B1

(12) United States Patent
Arbuckle et al.

(10) Patent No.: US 11,673,633 B1
(45) Date of Patent: Jun. 13, 2023

(54) MARINE PROPULSION SYSTEM AND CONTROL METHOD

(71) Applicant: Brunswick Corporation, Mettawa, IL (US)

(72) Inventors: Jason S. Arbuckle, Horicon, WI (US); Matthew W. Snyder, Fond du Lac, WI (US); Travis C. Malouf, Germantown, WI (US); Robert R. Osthelder, Omro, WI (US)

(73) Assignee: Brunswick Corporation, Mettawa, IL (US)

( * ) Notice: Subject to any disclaimer, the term of this patent is extended or adjusted under 35 U.S.C. 154(b) by 257 days.

(21) Appl. No.: 17/015,608

(22) Filed: Sep. 9, 2020

(51) Int. Cl.
*B63H 21/21* (2006.01)
*B63B 79/40* (2020.01)
*B63B 79/30* (2020.01)

(52) U.S. Cl.
CPC ..... *B63B 79/40* (2020.01); *B63B 79/30* (2020.01); *B63H 21/21* (2013.01); *B63H 2021/216* (2013.01)

(58) Field of Classification Search
CPC ..... B63H 21/21; B63H 3/10; B63H 21/22; B63H 21/38; B63H 21/14; B63H 2021/216; F02D 29/02; B63B 79/10; B63B 79/30; B63B 79/40
See application file for complete search history.

(56) References Cited

U.S. PATENT DOCUMENTS 5,366,393 A * 11/1994 Uenage ..... B63H 20/10 440/61 G
6,298,824 B1 10/2001 Suhre
6,701,890 B1 3/2004 Suhre et al.
7,641,525 B2 * 1/2010 Morvillo ..... B63B 39/00 440/42
9,103,287 B1 8/2015 Arbuckle et al.
9,290,252 B1 3/2016 Yuchscherer et al.
9,359,057 B1 * 6/2016 Andrasko ..... B63H 20/12
9,777,655 B1 * 10/2017 Arbuckle ..... F02D 41/1401
9,868,501 B1 1/2018 Gable et al.
9,908,606 B1 * 3/2018 Andrasko ..... B63H 21/213
9,950,778 B2 * 4/2018 Kabel ..... B63B 49/00
9,952,595 B2 * 4/2018 Arbuckle ..... B63H 21/21
(Continued)

OTHER PUBLICATIONS

Williams et al., Experiences with the Operation of a Commercially-Available Deep-Water AUV, 2007, IEEE, p. 1-9 (Year: 2007).*
(Continued)

*Primary Examiner* — McDieunel Marc
(74) *Attorney, Agent, or Firm* — Andrus Intellectual Property Law, LLP

(57) ABSTRACT

A method of controlling a plurality of marine drives on a marine vessel includes detecting that at least one of the plurality of marine drives and that at least one of the plurality of marine drives is not running, and then determining, based on the trim position of each of the at least one non-running marine drives, that at least one non-running marine drive is trimmed down. If so, an output limit restriction is effectuated for each of the at least one running marine drive and an alert is generated to advise an operator of the output limit restriction.

20 Claims, 7 Drawing Sheets

(56) References Cited

U.S. PATENT DOCUMENTS 9,975,619 B1 * 5/2018 Gonring ..... H02J 4/00

OTHER PUBLICATIONS

Moulton et al., An Autonomous Surface Vehicle for Long Term Operations, 2018, IEEE, p. 1-10 (Year: 2018).*
Skjong et al., Past, Present, and Future Challenges of the Marine Vessel's Electrical Power System, 2016, IEEE, pg. (Year: 2016).*
Oneto et al., Vessel monitoring and design in industry 4.0: A data driven perspective, 2016, IEEE, pg. (Year: 2016).*

* cited by examiner

MARINE PROPULSION SYSTEM AND CONTROL METHOD

FIELD

The present disclosure relates to methods and systems for controlling propulsion of a marine vessel, and specifically methods and systems for controlling propulsion of a marine vessel involving two or more marine drives when only a subset of the marine drives is running.

BACKGROUND

The following U.S. patents and patent applications are hereby incorporated herein by reference.

U.S. Pat. No. 6,298,824 discloses a control system for a fuel injected engine that provides an engine control unit that receives signals from a throttle lever that is manually manipulated by an operator of a marine vessel. The engine control unit also measures engine speed and various other parameters, such as manifold absolute pressure, temperature, barometric pressure, and throttle position. The engine control unit controls the timing of fuel injectors and the injection system and also controls the position of a throttle plate. No direct connection is provided between a manually manipulated throttle lever and the throttle plate. All operating parameters are either calculated as a function of ambient conditions or determined by selecting parameters from matrices which allow the engine control unit to set the operating parameters as a function of engine speed and torque demand, as represented by the position of the throttle lever.

U.S. Pat. No. 9,103,287 discloses drive-by-wire control systems and methods for a marine engine that utilize an input device that is manually positionable to provide operator inputs to an engine control unit (ECU) located with the marine engine. The ECU has a main processor that receives the inputs and controls speed of the marine engine based upon the inputs and a watchdog processor that receives the inputs and monitors operations of the main processor based upon the inputs. The operations of the main processor are communicated to the watchdog processor via a communication link. The main processor causes the watchdog processor to sample the inputs from the input device at the same time as the main processor via a sampling link that is separate and distinct from the communication link. The main processor periodically compares samples of the inputs that are simultaneously taken by the main processor and watchdog processor and limits the speed of the engine when the samples differ from each other by more than a predetermined amount.

U.S. Pat. No. 9,290,252 discloses systems and methods for controlling trim position of a marine propulsion device on a marine vessel. The system comprises a trim actuator having a first end that is configured to couple to the marine propulsion device and a second end that is configured to couple to the marine vessel. The trim actuator is movable between an extended position wherein the marine propulsion device is trimmed up with respect to the marine vessel and a retracted position wherein the marine propulsion device is trimmed down with respect to the marine vessel. Increasing an amount of voltage to an electromagnet increases the shear strength of a magnetic fluid in the trim actuator thereby restricting movement of the trim actuator into and out of the extended and retracted positions and wherein decreasing the amount of voltage to the electromagnet decreases the shear strength of the magnetic fluid thereby facilitates movement of the trim actuator into and out of the extended and retracted positions. A controller is configured to adapt the amount of voltage to the electromagnet based upon at least one condition of the system.

U.S. Pat. No. 9,868,501 discloses a method for controlling propulsion of two or more marine drives in a marine vessel includes detecting a fault condition relating to a first marine drive, and determining, at a first control module associated with the first marine drive, a power limit restriction for the first marine drive based on the fault condition. The method further includes communicating the power limit restriction with the first control module on a CAN bus of the marine vessel, and receiving the power limit restriction at a second control module associated with a second marine drive. The power output of the second marine drive is then reduced based on the power limit restriction for the first marine drive.

U.S. patent application Ser. No. 16/152,554, filed Oct. 5, 2018, discloses a marine propulsion system for a marine vessel that includes a first marine propulsion device rotatable with respect to the marine vessel about at least one of a first steering axis and a first tilt-trim axis and a second marine propulsion device rotatable with respect to the marine vessel about at least one of a second steering axis and a second tilt-trim axis. A first control module controls operation of the first marine propulsion device, and a second control module controls operation of the second marine propulsion device. In response to one of the first and second marine propulsion devices being commanded to rotate about at least one of its respective first or second steering axis and its respective first or second tilt-trim axis, the respective first or second control module of the other of the first and second marine propulsion devices is turned on.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of a method of controlling a plurality of marine drives on a marine vessel includes detecting that at least one of the plurality of marine drives and that at least one of the plurality of marine drives is not running, and then determining, based on the trim position of each of the at least one non-running marine drives, that at least one non-running marine drive is trimmed down. If so, an output limit restriction is effectuated for each of the at least one running marine drive and an alert is generated to advise an operator of the output limit restriction.

In one embodiment, a marine propulsion system includes at least two marine drives and a control system communicatively connected to the at least two marine drives. The control system is configured to detect that at least one of the marine drives is not running while the other drives are running. The control system then determines, based on the trim position of each non-running marine drive, that at least one of the non-running marine drives is trimmed down. An output limit restriction is then effectuated for each of the at least one running marine drives in order to prevent a speed condition of the marine vessel and/or a speed condition of at least one of the marine drives from exceeding a speed threshold. An alert is generated to advise the operator of the output limit restriction.

Various other features, objects and advantages of the invention will be made apparent from the following description taken together with the drawings.

BRIEF DESCRIPTION OF THE FIGURES

The Figure is a schematic depiction of a marine vessel incorporating one example of architecture according to the present disclosure.

DETAILED DESCRIPTION

Figure 1:
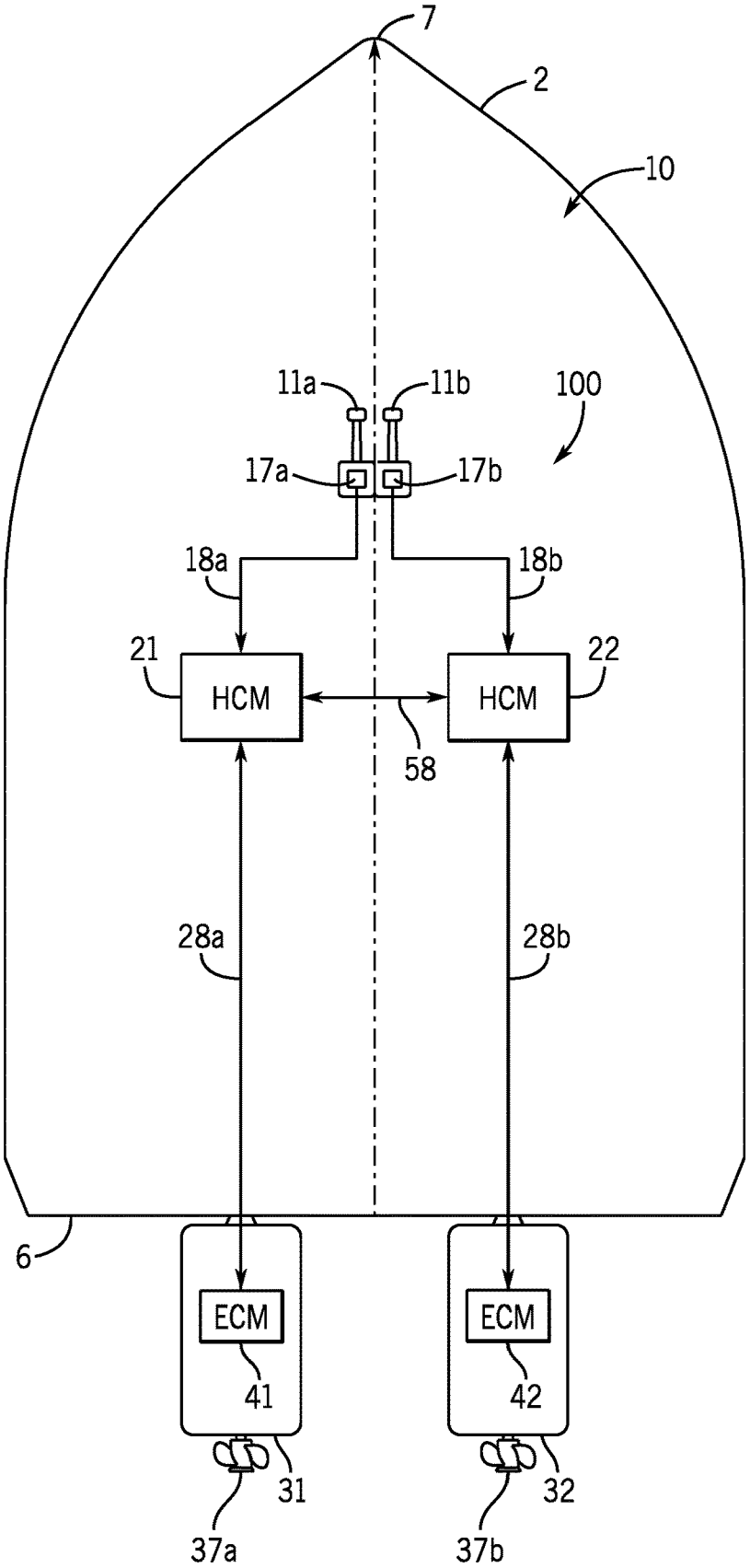
FIG. 1 depicts one embodiment of a propulsion system on a marine vessel.

The present inventors have recognized a problem with certain multi-drive propulsion systems relating to situations where only a subset of the plurality of marine drives is running and one or more of the drives is not running while the vessel is underway. This may occur where, for example, an operator keys on only a subset of the drives in order to propel the marine vessel at a relatively slow speed, such as to exit a marina. An operator may intentionally operate only a portion of the drives on a vessel in order to minimize wear on the drives, save fuel, etc. Additionally, a subset of the plurality of marine drives on a vessel may be running if one or more of the marine drives encounters a problem such that it is not operable or should not be operated. When only a subset of the drives on a marine vessel is operated, the non-operating subset of drives is often dragged through the water while the vessel is underway, remaining trimmed down to a normal operating trim position such that the propeller of the non-operating drive remains in the water. This causes the propeller of that drive to rotate, which in turn rotates the transmission within that drive. For certain types of marine drives, such rotation when the drive is not operating can be problematic. For example, in some drives the transmission is not lubricated when the engine is not running and thus can be damaged if rotated at a high speed when the engine is off.

The inventors have further recognized that other problems or undesirable effects may occur where only a subset of marine drives is running, such as steering constraints or undesirable rudder effects by the non-operating drive(s). In view of these challenges and problems recognized by the inventors, they developed the disclosed system and method whereby an output limit restriction is imposed in situations where only a subset of the drives on a vessel are running and at least one non-running marine drive remains trimmed down such that its propeller is in the water. In conjunction with the output limit restriction, an alert may be generated to an operator advising of the output limit restriction and/or instructing the operator to trim up the one or more non-operating marine drives such that all non-operating marine drives are trimmed up and out of the water.

Accordingly, the propulsion system is configured to prevent damage to non-running marine drives by preventing them from being dragged through the water at high speeds, and/or to prevent other negative consequences of dragging non-operating marine drives through the water while the vessel is underway. Once the operator trims up the marine drives, or otherwise starts the non-operating drives so that they are running, the output limit restriction may be removed. In certain embodiments, removing the output limit restriction may further require the operator to move one or more throttle levers of the operating marine drives back to an idle position or some other threshold lever position prior to removing the output limit restriction.

In one embodiment, the method and system regard a drive protection scheme where, once it is identified that a non-operating marine drive is trimmed down, the output limit is immediately effectuated. In other embodiments, the system may be configured to first determine that a speed condition of the marine vessel and/or a speed condition of at least one of the marine drives is at or near a speed threshold prior to implementing the output limit restriction. The speed threshold may represent a maximum speed condition at which the transmission of the non-running marine drive that is trim down will not be damaged. For example, the speed condition may be one or more of a vessel speed of the marine vessel, an engine speed of the at least one running marine drive, a throttle position of the at least one running marine drive, and/or a transmission speed of the at least one non-running marine drive that is trimmed down.

Figure 2:
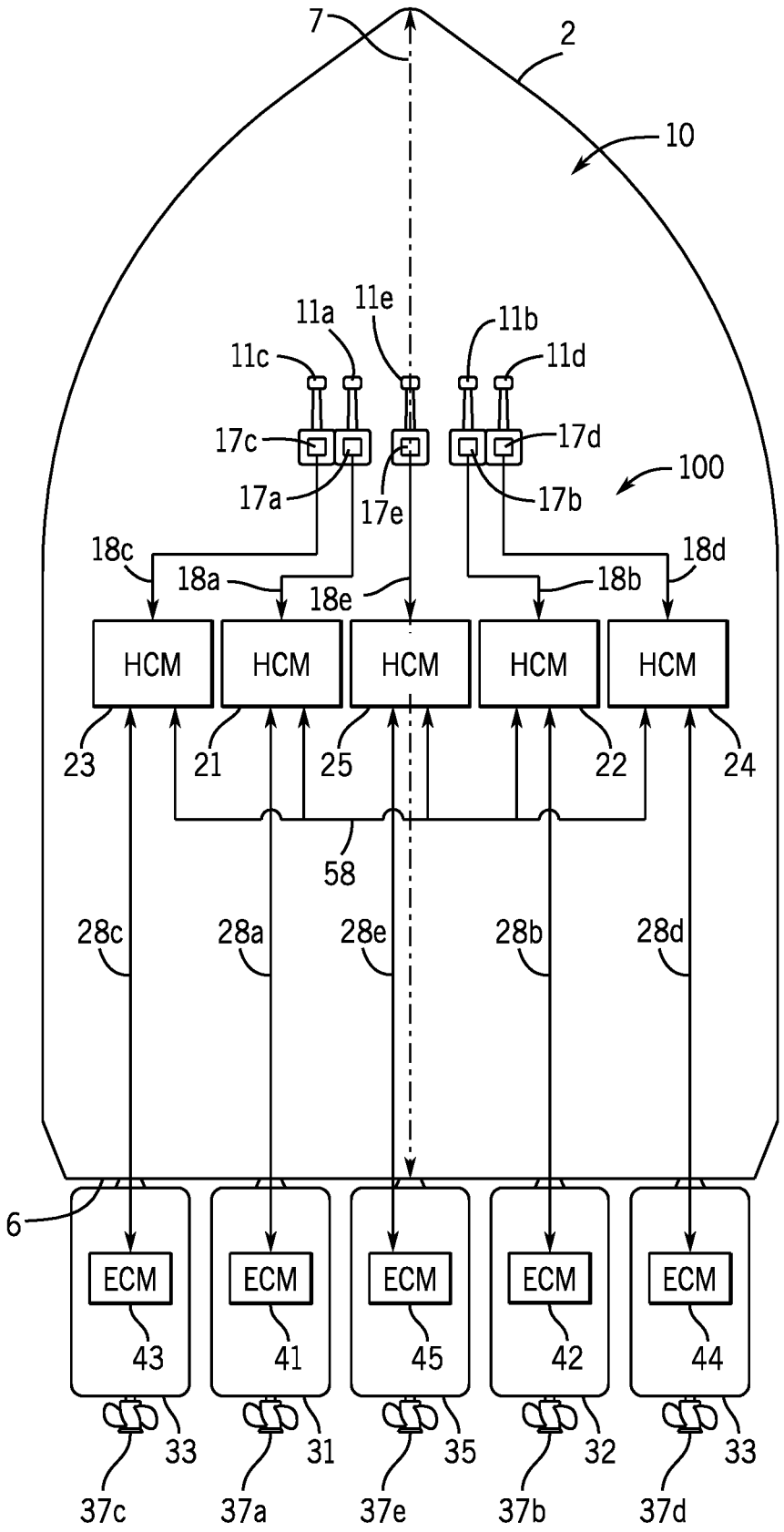
FIG. 2 depicts another embodiment of a propulsion system on a marine vessel.

FIGS. 1 and 2 illustrate a marine vessel 2 having a propulsion system 10 for controlling propulsion in accordance with the present disclosure. The propulsion system 10 includes a plurality of marine drives (31 and 32 FIGS. 1 and 31-35 in FIG. 2), which in the depicted embodiments are outboard motors coupled to the transom 6 of the marine vessel 2. The marine drives 31-35 are attached to the marine vessel 2 in a conventional manner such that each is rotatable about a respective vertical steering axis in order to steer the marine vessel 2 and is rotatable about a horizontal trim axis in order to trim the drives up and down. In the examples shown and described, the marine drives 31 and 32 (and 31-35 in FIG. 2) are outboard motors; however, the concepts of the present disclosure are not limited for use with outboard motors and can be implemented with other types of marine drives, such as stern drives.

In the examples shown and described, the marine drives have an engine that causes rotation of the drive shaft to thereby cause rotation of a propeller shaft having a propeller 37 at the end thereof, which will be understood as referring to a propeller or an impeller, or combination thereof. The propeller 37 is connected to and rotates with the propeller shaft propels the marine vessel 2. The direction of rotation of the propeller 37 is changeable by a gear system (e.g., a transmission), which has a forward gear associated with a forward thrust caused by a first rotational direction and a reverse gear associated with a backward thrust caused by the opposite rotational direction. As is conventional, the gear system (e.g., a transmission) is positionable between the forward gear, a neutral state (no thrust output), and the reverse gear. Such positioning is typically controlled by a remote control 11 (FIGS. 1-3) associated with the respective marine drive 31-35. As is conventional, the remote control 11 includes a lever 50 (FIG. 3) movable by an operator into a reverse position at causes the gear system to shift into reverse gear, a neutral position that causes the gear system to shift into a neutral state, and a forward position that causes the gear system to shift into forward gear. The remote control lever 50 is also movable by an operator to provide throttle control, and thus thrust control, within the respective gear position.

The propulsion system includes a control system 100 that includes one or more controllers and communication networks for effectuating propulsion control, such as based on user input. Referring to FIG. 1, each marine drive 31, 32 is controlled by a respective helm control module (HCM) or command control module (CCM) 21, 22, which is communicatively connected to an engine control module (ECM) 41, 42 for that respective marine drive 31, 32. The connection between the HCM 21, 22 and the ECM 41, 42 is via a communication link 28*a*, 28*b*, respectively, which in may be by any known means and in various embodiments could be a CAN bus for the marine vessel, a dedicated communication bus between the respective control modules 21 and 41, 22 and 42, via a wireless communication protocol, or via other communication means implemented for facilitating communication between electronic devices on a marine vessel. The first HCM 21 and the second HCM 22 are communicatively connected via communication link 58 so that information can be exchanged therebetween, which may also be by any known means including via CAN. In certain embodiments, the HCMs 21 and 22 may communicate instead via the same communication link 28 that facilitates communication with the ECMs 41 and 42.

Thereby, communication is facilitated between the HCMs and the ECMs, whereby the ECM communicates communicate engine parameters—e.g., engine state (stall, crank, or run), engine rpm, throttle position, transmission speed, etc.—and the HCM can communicate control instructions—e.g. output commands based (such as based on user inputs to control throttle, steering, and/or trim) and/or output restrictions. In other embodiments, the methods and systems described herein may be accomplished by the ECMs 41 and 42 associated with the respective marine drives 31 and 32 without the involvement of HCMs or other additional control modules, and in such an embodiment the ECMs 41 and 42 may be connected by any wired or wireless communication link as described above. For example, the ECMs 41 and 42 may directly communicate their engine states, engine speeds, etc. with one another, and may be equipped to execute some or all of the methods described herein for determining and implementing an output limit.

Each HCM 21, 22 is communicatively connected to a remote control 11*a*, 11*b* for controlling the operation of the respective marine drive 31, 32. In another embodiment, both marine drives 31 and 32 are controlled by a single remote control 11 communicatively connected to both HCMs 21, 22 such that the throttle request is the same for the two drives and the throttles are not separately controllable by an operator. In a preferred embodiment, the remote control 11 is a drive-by-wire input device, and the position of the lever 50 sensed by the position sensor 17 will be translated into a control input to a throttle valve, for example. Such drive-by-wire systems are known in the art, an example of which is disclosed at U.S. Pat. No. 9,103,287 incorporated herein by reference.

The control system 100 arrangement depicted and described at FIGS. 1 and 2 is merely representative and various other arrangements are known and within the scope of the disclosure. For example, each drive may comprise two or more controllers, such as a powertrain control module (PCM) and a thrust vector module (TVM), as is well-known in the art. In other alternative control system 100 arrangements, a central control module may be provided in addition to or in place of the HCMs 22, 23.

Figure 3:
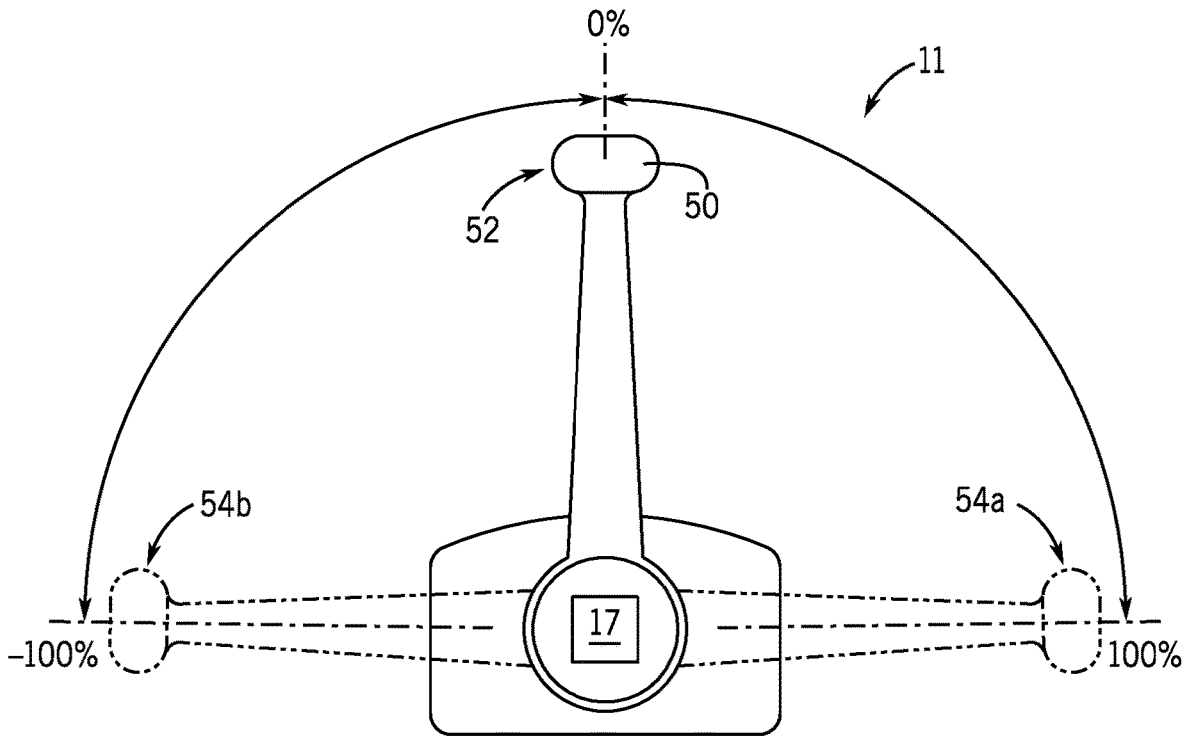
FIG. 3 illustrates one embodiment of a remote control for a system for controlling propulsion of a marine vessel.

As shown in FIG. 3, each remote control 11 has a lever 50 positionable between a neutral lever position 52 associated with engine idle and a neutral position of the gear system, and a full forward lever position 54*a* and a full reverse lever position 54*b*. The full throttle lever positions 54*a*, 54*b* are associated with an output value, such as engine RPM or maximum power output value. For example, lever position may be mapped to an RPM setpoint and airflow and power output are thus controlled accordingly to run the engine at that RPM. The position of the lever 50 is determined by the position sensor 17 providing an analog output or a digital output of angular position to a respective helm control module 21, 22. The position of the lever 50 may be expressed as a percent of the range of motion of the lever 50 in the respective direction—i.e., between 0% and +100% in the forward position and between 0% and −100% in the reverse direction. Each lever position between 0% and 100% is determined by the respective HCM 21, 22 to provide a throttle control command to control the throttle valve to provide a corresponding power output. For instance, a lever position of 50% corresponds with throttle control to provide 50% power output. For example, the position sensor 17 may be a programmable magnetic encoder, a clinometer, a Hall Effect sensor, a potentiometer, a rotary encoder, or the like.

On a vessel with a plurality of marine drives, the marine drives are generally positioned symmetrically about a centerline 7 of the marine vessel 2 so that the forces on the marine vessel balance and no appreciable net torque on the marine vessel is created when the marine drives 31 and 32 are in the straight ahead position—i.e., when the force created by the propulsor 37*a*-37*e* for the marine drive 31-35 is in the straight ahead direction parallel with the centerline 7. Accordingly, a marine vessel 2 equipped with two marine drives 31 and 32 (FIG. 1) has the marine drives positioned equidistant from the centerline 7. Similarly, when additional marine drives are added to the system, they are positioned so that no net torque is provided when all marine drives are in the straight ahead position. Accordingly, a third marine drive added to the system would be added directly in the center marine vessel. FIG. 2 illustrates this concept, having five marine drives 31-35 positioned symmetrically about the centerline 7. Specifically, the first marine drive 31 and the second marine drive 32 are positioned on the inner port side and inner starboard side, respectively, about the centerline 7. The third marine drive 33 and fourth marine drive 34 are positioned on the outer port side and outer starboard side, respectively, and equidistant from the centerline 7. The fifth marine drive 35 is positioned in the center along the transom 6.

Similar to the system described above with respect to FIG. 1, the system depicted in FIG. 2 includes a helm control module 21-25 for each marine drive 31-35, which is communicatively connected via communication link 28*a*-28*e* to the engine control module 41-45 for each marine drive 31-35. Additionally, in the embodiment of FIG. 2, each marine drive 31-35 has an associated remote control 11*a*-11*e* having a position sensor 17*a*-17*e* as described above, such that the output power, or thrust, can be controlled by a user.

Each remote control 11*a*-11*e* is connected to the HCM 21-25 for the respective marine drive 31-35 via communication link 18*a*-18*e*, which as described above may be a CAN bus, a dedicated communication bus, or a wireless communication link. In certain embodiments, the communication links 18*a*-18*e* may be the same CAN bus as the communication links 58, and/or the same bus as communication links 28*a*-28*e*.

Figure 4:
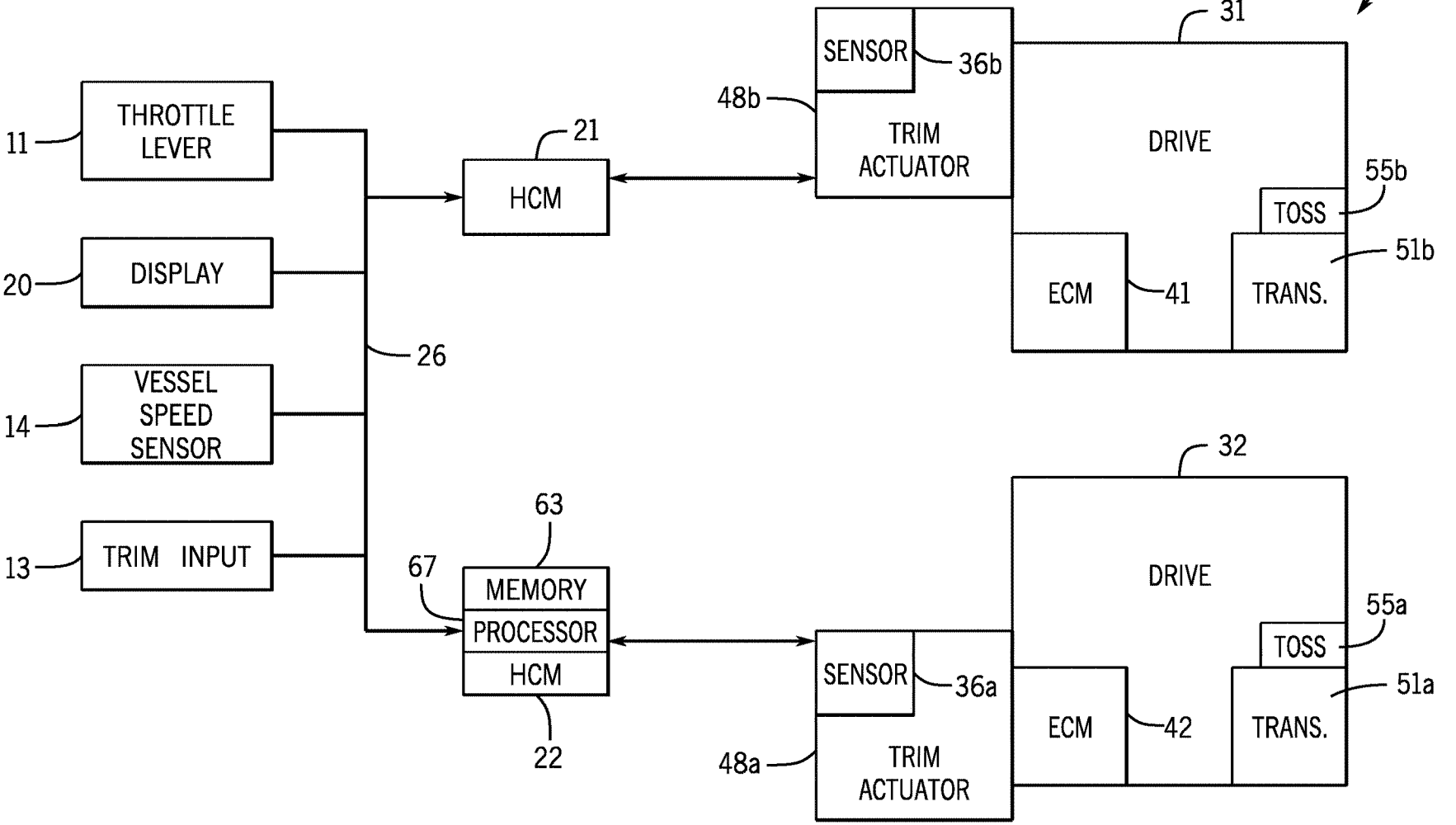
FIG. 4 is a schematic exemplifying one embodiment of a marine propulsion system and control system for controlling a plurality of marine drives according to the present disclosure.

Referring now to FIG. 4, the propulsion system 10 further includes a trim actuator 48 and a steering actuator (not shown) associated with each drive 31-32 (or 31-35). In the depicted example, each HCM 21 and 22 is communicatively connected (e.g., via the CAN bus arrangement 28*a*, 28*b*) and configured to control the trim actuators 48 and steering actuators; however, various other control arrangements are possible and well known in the relevant art. The trim actuators 48*a*, 48*b* move the marine drives 31 and 32 to a commanded trim position, e.g., in response to signals sent from the HCMs 21, 22. For example, such commands may be based on input from the user via a trim control input device 23 (e.g., trim control buttons). Further, the system 10 comprises trim angle sensors 36*a*, 36*b* for sensing current trim positions of each marine drive 31, 32 and providing this data to the control modules via the CAN bus 26.

Now referring to FIGS. 5-8, various trim positions of the marine drives 31, 32 (or 31-35) will be described. In the example shown in FIGS. 5-8, only the starboard marine drive 32 is shown. However, it should be understood that all of the plurality of marine drives are movable between a minimum trim position where the drive is fully trimmed down and a maximum trim position where the drive is fully trimmed up, as shown in these figures. It should also be understood that the trim position of each marine drive 31, 32 (or 31-15) are separately controllable.

Figure 5:
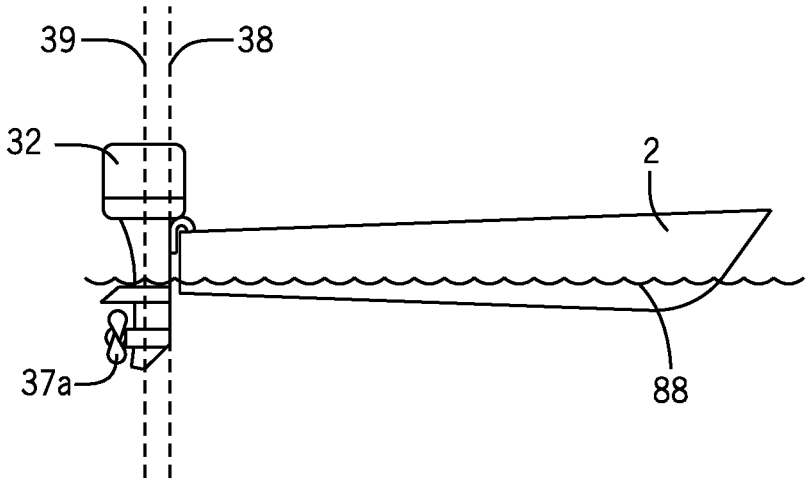
FIG. 5 is a side view of a marine vessel having a marine drive in a trimmed down position which is a vertical trim position.
Figure 6:
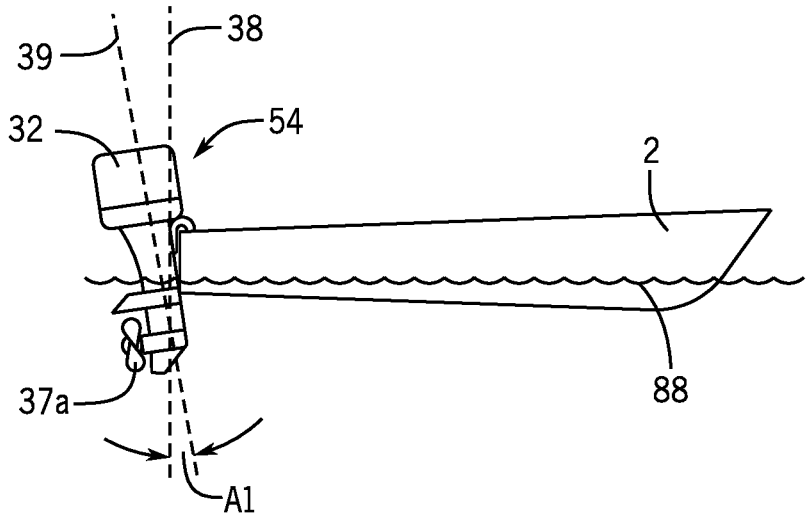
FIG. 6 is a side view of a marine vessel having a marine drive in a minimum trim position where the drive is fully trimmed down.

In each of FIGS. 5-8 the trim position of the marine drive 31, 32 is shown with respect to a dashed line representing a vertical axis 38. Additionally, another dashed line in each of the figures represents a longitudinal axis 39 through the marine drive 32. The angle between the vertical axis 38 and the longitudinal axis 39 is the trim angle A. In FIG. 5, the marine drive 32 is in a neutral trim position in which the vertical axis 38 and the longitudinal axis 39 are generally parallel to one another. In FIG. 6, the marine drive 32 is trimmed all the way down (or fully trimmed in) such that a propeller 37*b* of the marine drive 32 is closer to the hull of the marine vessel 2 than when the marine drive 32 is in the neutral trim position. In the fully trimmed down position, the marine drive 32 is angled such that the propeller 37*b* is closer to the hull of the marine vessel 2 than when in the neutral position, and its longitudinal axis 39 is oriented at an angle A1 with respect to the vertical axis 38. This position is sometimes referred to as "full tuck."

Figure 7:
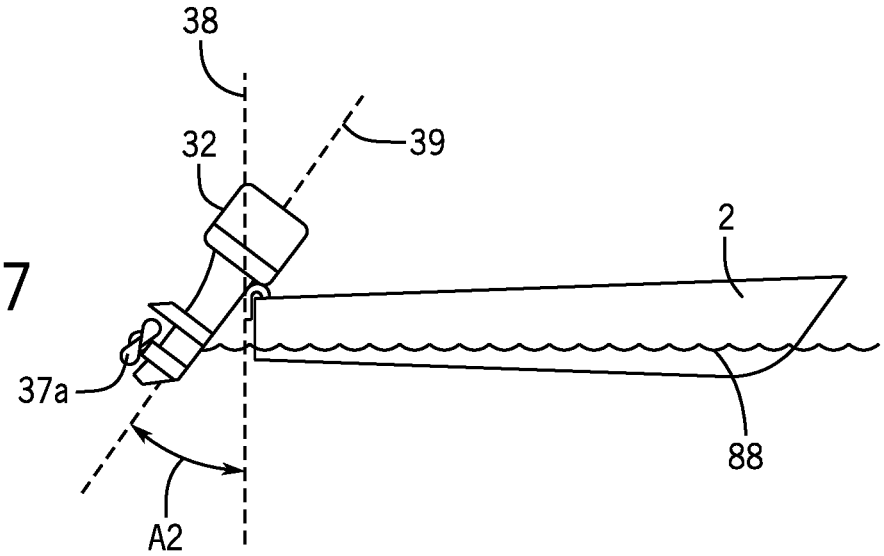
FIG. 7 is a side view of a marine vessel having a marine drive in a trimmed up position.
Figure 8:
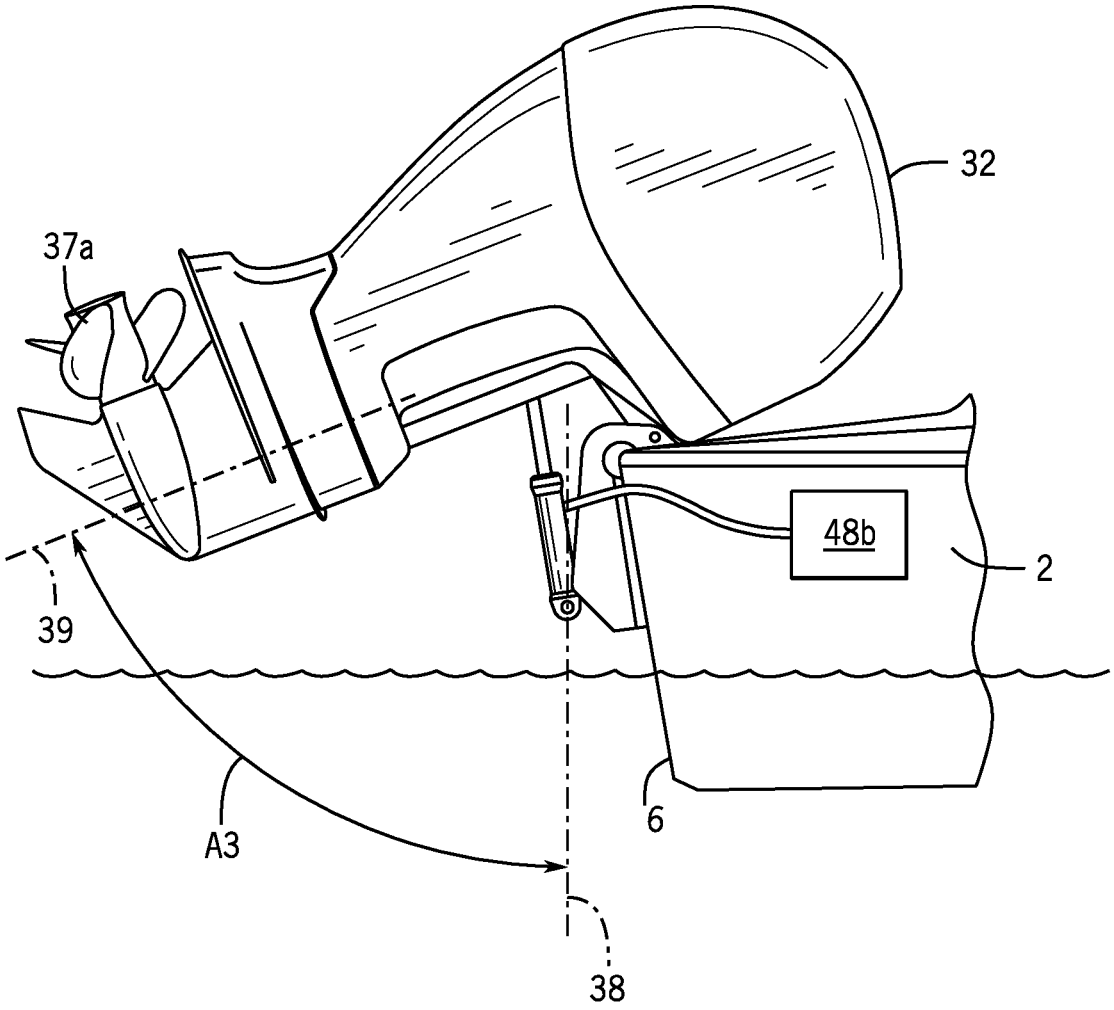
FIG. 8 is a side view of a marine vessel having a marine drive in a maximum trim position where the drive is fully trimmed up.

In FIG. 7 the marine drive 32 is partially trimmed up (trimmed out) such that the propeller 37*a* is further from the hull. Here, the propeller 37*b* of the drive 32 is at or near the water surface 88. The longitudinal axis 39 extends at an angle A2 with respect to the vertical axis 38. To provide just one example, the angle A2 may be around 30 degrees of trim, which in various embodiments may be greater or less depending on the vessel configuration, drive configuration, etc. For trim positions above, or greater than, that point, the propeller will be out of the water, particularly if the vessel is sitting at dock or idling. FIG. 8 is a closer depiction of the drive 32 trimmed up even further, which may represent a maximum trim position where the marine drive 32 is fully trimmed up and is lifted out of the water. Preferably, non-running marine drives are placed in this position, or at least above the position shown in FIG. 7 such that the propeller of the non-operating drive is fully out of the water. In this position, the drive 32 is lifted out of the water so that the propeller is not rotated (so as not to rotate the transmission), and/or so that it does not create drag, limit steering angles of neighboring drives, and is otherwise out of the way.

Returning to FIG. 4, an exemplary propulsion system 10 is shown. As described hereinabove, the control system 100 may receive input from a throttle lever 50, vessel speed sensor 14, display 20, trim input 13 (e.g., trim control buttons) (collectively, the user input devices) communicatively connected (e.g. via CAN bus 28) to one or more controllers, such as HCMs 21, 22. The HCMs 21, 22 interpret these signals and send commands to the trim actuators 48*a* and 48*b*, the marine drives 31, 32, etc. Trim control input 13 may be configured to receive user inputs to adjust trim position of one or more of the marine drives (e.g., 31-35), and preferably the trim control input 13 is configured such that the user separately controls the trim position of each drive. The vessel speed sensor 14 may be, for example, a pitot tube sensor, a paddle wheel sensor, or any other speed sensor appropriate for sensing the actual speed of the marine vessel. Alternatively or additionally, the vessel speed sensor may be a GPS device that calculates vessel speed by determining how far the vessel has traveled in a given amount of time. The display 20 may comprise part of a user interface system at the vessel helm. In one embodiment, the display 20 may comprise part of an on-board management system for the marine vessel 2, such as a VesselView® by Mercury Marine of Fond Du Lac, Wis. In various embodiments, the display 20 may be a touch screen configured to facilitate user inputs, and/or the display 20 may be incorporated in a user interface system that further includes one or more input devices for facilitating user input, such as a keyboard, push buttons, etc.

Each of the controllers (HCMs, ECMs, etc.) may have a memory and a programmable processor, such as processor 67 and memory 63 in HCM 22. As is conventional, the processor 67 can be communicatively connected to a computer readable medium that includes volatile or nonvolatile memory upon which computer readable code (software) is stored. The processor 67 can access the computer readable code on the computer readable medium, and upon executing the code can send signals to carry out functions according to the methods described hereinbelow. Execution of the code allows the control system 100 to control one or more actuators (for example trim actuators 48*a*, 48*b*) and various other systems in or associated with the marine drives 31, 32. Processor 67 can be implemented within a single device but can also be distributed across multiple processing devices or sub-systems that cooperate in executing program instructions. Examples include general purpose central processing units, application specific processors, and logic devices, as well as any other type of processing device, combinations of processing devices, and/or variations thereof. The control system 100 may also obtain data from sensors aboard the vessel (e.g., trim position sensors 36*a* and 36*b*, and the processor 67 may save or interpret the data as described hereinbelow. In the example shown, at least on HCM 22 comprises a memory 63 (such as, for example, RAM or ROM), although the all control modules may comprise such storage.

As described above, the system may be configured to effectuate an output limit restriction for each running marine drive in order to prevent damage or otherwise undesirable conditions when non-running marine drives remain trimmed down while the vessel 2 is underway. As described above, one concern regards damage to the transmissions of the non-running marine drives when they are dragged through the water at sufficient speed. Accordingly, the control system 100 may be configured to effectuate an output limit restriction for each running marine drive that prevents the vessel and or the marine drives 31, 32 from exceeding a speed threshold. In various environments, the speed condition and corresponding speed threshold maybe one or more of a transmission speed of the non-running marine drive that is trimmed down, an engine speed of one or more of the running marine drives, a throttle position of one or more of the running marine drives, or a vessel speed.

As is well known, each marine drive 31, 32 includes a transmission 51*a*, 51*b* driven into rotation by the engine of the marine drive. The output shaft of the transmission drives rotation of the propeller 37*a*, 37*b*. Conversely, rotation of the propeller 37*a*, 37*b* induces rotation of the transmission 51*a*, 51*b* when a non-running drive 31, 32 is being drugged through the water. This rotation, if at a sufficiently high speed and or maintained for a sufficient time, can damage the transmission. Thus, in certain embodiments, the speed threshold is set to avoid damaging the transmission of a non-running marine drive that is trimmed down. In such embodiments, the speed threshold represents a maximum speed condition at which a transmission of the non-running marine drive that is trimmed down will not be damaged, even when that maximum speed condition is maintained for an extended duration.

In certain embodiments, the speed condition and corresponding speed threshold is a transmission speed, such as a transmission output speed, measured from the transmission 51*a*, 51*b* of each drive 31, 32. For example, the transmission speed may be measured by a transmission output speed sensor (TOSS). To provide just one example, the TOSS sensor 55*a*, 55*b* may be at a variable reluctance sensor or a hall effect sensor configured to sense rotational speed of the output shaft of the transmission, and in some embodiments may also be configured to determine output shaft angular position and/or rotational direction. In other embodiments, the speed condition may be a vessel speed, engine speed, throttle position, etc. measured or obtained as described herein.

Figure 9:
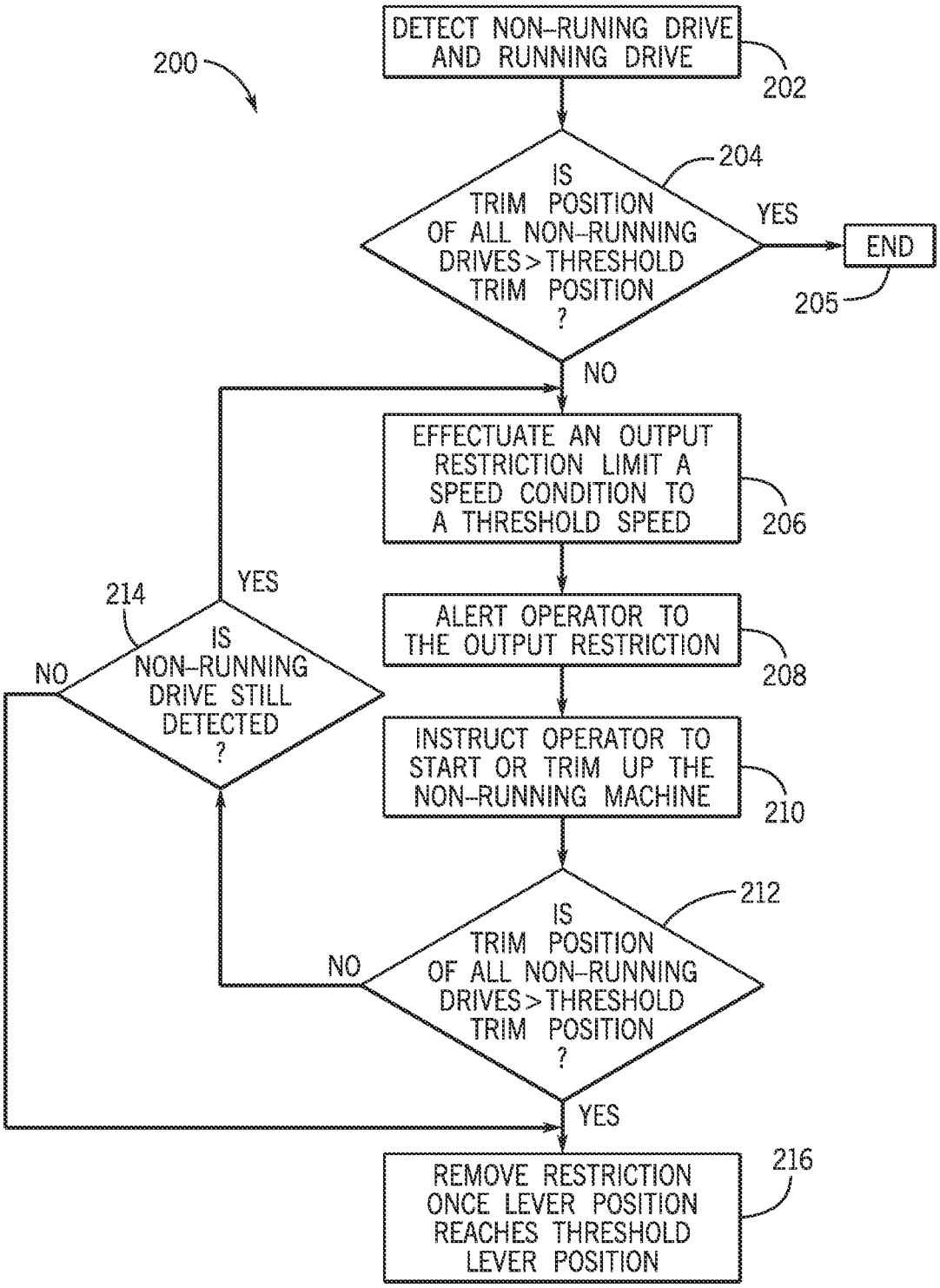
FIG. 9 is a flow chart depicting an exemplary method for controlling a plurality of marine drives.

FIG. 9 demonstrates an exemplary method 200 for controlling the plurality of marine drives. When at least a subset of the marine drives (e.g., 31 or 32, or any one of 31-35) is not running and the remaining subset of drives is running, then logic is conducted to ensure safe operation as described herein. The running and non-running statuses of the marine drives on the vessel are detected at step 202. For example, the control system 100 may be configured to identify which of the plurality of marine drives are running and which of the plurality of marine drives are not running based on information provided by the engine controllers (e.g., ECM 41, 42), such as an engine speed of each marine drive, a throttle position of each marine drive, and/or an engine state of each marine drive. The engine state may be, for example, one of a stall, crank, or run state, such as determined by each ECM 41, 42 for each drive 31, 32. In one embodiment, each engine controller 41, 42 may be configured to communicate the engine speed, throttle position, and/or engine state of each marine drive to the respective helm controller 21, 22. For example, the control system 100, and the engine controllers in particular, may be configured to operate in a "global wake" mode where certain limited functions and processes are carried out even when the engine of the marine drive 31, 32 is not running, as exemplified and described at U.S. patent application Ser. No. 16/152,554 which is incorporated herein by reference. Each helm controller 21, 22 may be configured to execute the logic described herein in order to ensure safe operation of its respective associated marine drive 31, 32. In other embodiments, the methods and steps described herein for protecting non-running marine drives may be executed at a centralized location, such as a designated one of the helm controllers 21, 22.

Once it is detected that only a subset of the marine drives is running, logic is executed to determine whether any of the non-running marine drives are trimmed down. In the depicted embodiment, step 204 is executed to determine whether the trim position of the non-running marine drives is greater than a threshold trim position. For example, the threshold trim position may be a trim angle above which the propeller 37 of the respective marine drive is sufficiently above the water surface 88 such that it will not be dragged through the water and caused to rotate while the marine vessel is underway. If the trim position of one or more of the non-running drives is less than the threshold trim position, then it is determined that the at least one non-running marine drive is trimmed down and that logic should be executed to impose an output restriction. If, on the other hand, the trim position of all non-running drives is greater than the threshold trim position, than the inquiry is ended at step 205 and no output limit restriction is imposed.

When one of the non-running marine drives is trimmed down, the output restriction limit is imposed by the control system 100 at step 206 in order to prevent a speed condition of the marine vessel and/or at least one of the marine drives from exceeding a speed threshold. Namely, the power output of the operating drives is sufficiently limited so that the speed threshold is not exceeded. As described above, the speed threshold may be any value or condition relating to speed of the vessel or the marine drives, such as vessel speed, engine speed, throttle position, transmission speed, etc. For example, the output limit restriction may be a limitation on the maximum power output of the running marine drives. Such output limit restrictions are known in the relevant art and implemented in certain conditions, such as upon detection of a fault condition or failure condition.

An alert may be generated at step 208 to advise the operator that the output restriction limit is in effect. For example, the alert may be provided via the display 20 or other user interface element, such as a speaker. For example, an alert may be provided on a digital display 20 at the helm of the vessel 2 advising the operator of the output limit restriction and the reason therefore—namely, that one or more non-running marine drives remains trimmed down. The system 100 may further be configured to operate the display 20 to generate an instruction at step 201 to instruct the operator to either start the non-running marine drive or trim it up such that the propeller is out of the water.

As represented by step 214, the control system 100 then monitors to detect when and if the trim position of the offending non-running marine drives reaches the threshold trim position at step 212. Likewise, the control system is configured to determine whether the non-running marine drives are instead started up such that they are no longer in a compromised state. Once the non-running drives are either started or trimmed up, the output limit restriction can be removed. In the depicted example, the control system 100 is configured to require that the lever position of each output limited marine drive (e.g., each of the prior-identified running marine drives detected at step 202) reaches idle prior to unlatching the output limit. For example, the system 100 may be configured to require that the remote control lever 50 reach a lever position associated with engine idle and/or associated with a neutral gear state of the transmission 51, or some other threshold lever position, prior to removing the restriction.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A method of controlling a plurality of marine drives on a marine vessel, the method comprising:

detecting, by a control system, that at least one of the plurality of marine drives is running and that least one of the plurality of marine drives is not running;

determining, by the control system, based on a trim position of each of the at least one non-running marine drive, that at least one non-running marine drive is trimmed down;

effectuating an output limit restriction for each of the at least one running marine drive including controlling, by the control system, each of the at least one running marine drive so as not to exceed the output limit restriction; and generating an alert to an operator of the output limit restriction.

2. The method of claim 1, further comprising generating an instruction to the operator to trim up the at least one non-running marine drive that is trimmed down.

3. The method of claim 1, further comprising removing the output limit restriction after every non-running marine drive is trimmed up to at least a threshold trim position.

4. The method of claim 3, wherein the threshold trim position is a trim position above which a propeller of the non-running marine drive is above a water surface.

5. The method of claim 1, wherein determining that the at least one non-running marine drive is trimmed down includes determining that the trim position of the respective marine drive is less than a threshold trim position.

6. The method of claim 1, wherein the output limit restriction prevents a speed condition of the marine vessel and/or at least one marine drive from exceeding a speed threshold.

7. The method of claim 6, wherein the speed threshold represents a maximum speed condition at which a transmission of the non-running marine drive that is trimmed down will not be damaged.

8. The method of claim 6, wherein the speed threshold is a transmission speed and the speed condition is a transmission speed of the at least one marine drive that is trimmed down.

9. The method of claim 6, wherein the speed threshold includes a vessel speed and the speed condition includes a vessel speed of the marine vessel.

10. The method of claim 6, wherein the speed threshold includes an engine speed and the speed condition includes an engine speed of the at least one running marine drive.

11. The method of claim 6, wherein the speed condition includes at least one of a vessel speed of the marine vessel, an engine speed of the at least one running marine drive, and a transmission speed of the at least one non-running marine drive that is trimmed down.

12. The method of claim 1, wherein the step of detecting the at least one running marine drive and the at least one non-running marine drive includes identifying which of the plurality of marine drives are running and which of the plurality of marine drives are not running based on at least one of an engine speed of each marine drive, a throttle position of each marine drive, and an engine state of each marine drive.

13. A marine propulsion system for a marine vessel comprising:

at least two marine drives;

a control system communicatively connected to the at least two marine drives and configured to:

detect that at least one of the marine drives is running and that least one of the marine drives is not running;

determine, based on a trim position of each of the at least one non-running marine drive, that at least one non-running marine drive is trimmed down;

effectuate an output limit restriction for each of the at least one running marine drive to prevent a speed condition of the marine vessel and/or at least one marine drive from exceeding a speed threshold; and generate an alert to an operator of the output limit restriction.

14. The system of claim 13, further comprising:

a user interface in communication with the control system;

wherein the control system is further configured to:

control the user interface to generate an instruction to the operator to trim up the at least one non-running marine drive that is trimmed down; and remove the output limit restriction after every non-running marine drive is trimmed up to at least a threshold trim position such that its propeller is above a water surface.

15. The system of claim 13, wherein the control system is further configured to determine that every non-running marine drive is trimmed up to at least a threshold trim position prior to removing the output limit restriction.

16. The system of claim 13, wherein the speed threshold represents a maximum speed condition at which a transmission of the non-running marine drive that is trimmed down will not be damaged.

17. The system of claim 16, wherein the speed threshold is a transmission speed and the speed condition is a transmission speed of the at least one non-running marine drive that is trimmed down.

18. The system of claim 16, wherein the speed threshold includes a vessel speed and the speed condition includes a vessel speed of the marine vessel.

19. The system of claim 16, wherein the speed threshold includes an engine speed and the speed condition includes an engine speed of the at least one running marine drive.

20. The system of claim 13, wherein the speed condition includes at least one of a vessel speed of the marine vessel, an engine speed of the at least one running marine drive, and a transmission speed of the at least one non-running marine drive that is trimmed down.

* * * * *